United States Patent [19]

Grew et al.

[11] Patent Number: 4,464,916

[45] Date of Patent: Aug. 14, 1984

[54] LOOP FOLLOWER STRAIGHTENER CONTROL IN A PRESS INSTALLATION

[75] Inventors: Gary T. Grew, New Knoxville; Ronald F. Fortman, Minster, both of Ohio

[73] Assignee: The Minster Machine Company, Minster, Ohio

[21] Appl. No.: 382,954

[22] Filed: May 28, 1982

[51] Int. Cl.[3] ..... B21C 19/00; B21B 37/04

[52] U.S. Cl. ..... 72/17; 72/160; 72/161; 226/44

[58] Field of Search ..... 72/161, 160, 17, 10, 72/12, 27; 226/44

[56] References Cited

U.S. PATENT DOCUMENTS

| | | | |
|---|---|---|---|
| 3,022,812 | 2/1962 | Groll | 72/160 |
| 3,807,613 | 4/1974 | Holm | 226/44 |
| 3,817,067 | 6/1974 | Voorehes et al. | 72/161 |
| 3,860,187 | 1/1975 | Liska et al. | 242/45 |
| 3,910,521 | 10/1975 | O'Callaghan et al. | 242/75.51 |
| 3,912,145 | 10/1975 | Meihofer | 226/44 |
| 3,913,900 | 10/1975 | Muster et al. | 226/44 |
| 3,974,949 | 8/1976 | Petersen | 226/44 |
| 3,998,368 | 12/1976 | Hackney | 226/44 |
| 4,008,661 | 2/1977 | Mathis | 226/44 |
| 4,266,461 | 5/1981 | Molitors | 226/44 |

*Primary Examiner*—Daniel C. Crane

*Attorney, Agent, or Firm*—Albert L. Jeffers; John F. Hoffman

[57] ABSTRACT

The present invention relates to a loop follower control system for use in a mechanical press or other machine installation for the purpose of controlling the amount of stock loop between the straightener and the press. An idler arm engages the loop of stock between the straightener and the press, and is connected to an potentiometer to develop a current or voltage proportional to the deviation of the idler arm from the desired position. The control current or voltage developed controls an eddy current drive to increase or decrease the speed of the rollers and straightener depending on the amount of error indicated by the control signal.

12 Claims, 5 Drawing Figures

LOOP FOLLOWER STRAIGHTENER CONTROL IN A PRESS INSTALLATION

BACKGROUND OF THE INVENTION

The present invention relates to a press installation, such as that comprising a mechanical stamping, forming, shearing, punching or assembling press, wherein strip stock is feed off a coil through a straightener into the press, and more particularly relates to an apparatus for controlling the loop of strip stock between the straightener and the infeed side of the press.

In mechanical presses, the stock is often supplied in strip form and is fed into the press by means of an intermittently operating feed device such as a cam feed or the like. In order to permit substantially continuous movement of the stock from the reel, strip stock supply systems often maintain a supply loop in the stock ahead of the press feed so that the intermittent advancement of the stock is substantially isolated from the supply. Furthermore, straighteners are often provided between the coil of stock and the press feed in order to continuously feed the stock to the press feed and remove the set imparted to the stock because of its coiled condition. Since straighteners are generally continuous rather than intermittent in operation, the provision of a stock loop is necessary.

It is known to control the operation of the straightener so as to maintain the loop of stock between the straightener and the press at a substantially constant size, or within given upper and lower ranges of the loop size. One prior art technique for controlling the size of the stock loop is to provide a pair of limit switches, one located near the floor which initiates a stop feeding signal to the straightener when the loop becomes too large, and a second limit switch located above the loop, which causes the straightener to begin running when the loop gets too tight. Thus, the straightener is started and stopped as the loop becomes larger and smaller within the predetermined range established by the limit switches. Although this technique is the least expensive to implement, the stock is supplied in a jerky fashion which may result in a misfeed due to the stock being pushed or pulled at the input of the press feed. Additionally, it may result in premature wear of the straightener and the straightener control because the straightener is started and stopped intermittently, rather than being able to run continuously.

A second prior art technique for controlling the stock loop between the straightener and the press is a fairly complicated digital system which monitors the size of the loop and then feeds back signals to a digital processor that controls the motor drive for the straightener. Although this type of loop control can be very precise in maintaining the loop within a given size range, and will tolerate a fair amount of stock bounce, the system is quite expensive due to the sophistication of the circuitry. An advantage of a more complicated system of this type that is particularly adapted for high speed press operation as disclosed in U.S. Pat. No. 3,817,067 assigned to The Minster Machine Company.

The problem to be solved is the provision of a straightener control capable of maintaining the loop at a substantially constant size without the intermittent operation of the start/stop control discussed above yet without the higher cost of the more sophisticated digital control system. Additionally, it is desirable to cause the loop to increase to a maximum predetermined size greater than the normal 'running' size when the loop press is stopped so that when the press is restarted, there will be sufficient material in the loop to enable the straightener to be started smoothly.

SUMMARY OF THE INVENTION

The loop follower control system of the present invention requires a small to medium loop storage, and utilizes a very simple control which makes it only slightly more expensive than the start/stop apparatus described earlier. At the same time, the control of the present invention offers most of the other features of the precision straightener control, although for very high speed press operation, the precision control may be preferred.

The loop follower control comprises a control arm, which is preferrably pivotally mounted, and has a roller that engages the center portion of the loop of stock between the straightener and the press feed. The control arm is connected to the input shaft of a potentiometer, preferably through a timing belt linkage or other suitable linkage that enables the angular displacement of the control arm to be amplified for more precise control of the potentiometer.

The output of the control potentiometer is connected to one input of a feedback control circuit which compares or otherwise processes the potentiometer output with a reference signal which can be varied by the press setup man. The result of the processing or comparing of these two signals is an output control signal that is connected to the control input of an eddy current coupling connected between a constant speed motor and the drive mechanism for the straightener rollers. As the output signal from the control potentiometer varies depending on the height of the stock loop between the straightener and the press, the feedback circuitry will produce a control signal that will cause the eddy current drive to speed up or slow down the rollers of the straightener. Specifically, if the loop becomes larger than optimum, the straightener will slow down proportionally, and if the loop becomes shorter than optimum, the straightener will be caused to speed up, again proportionally to the amount of deviation. An important distinction between the straightener control of the present invention and the prior art start/stop technique is that the motor drive changes speed in a smooth continuous fashion with the speed being proportional to the deviation between the potentiometer output and the reference signal. Accordingly, if the loop is only slightly larger than desirable, the straightener rollers will increase in speed by a proportionately small amount, whereas large deviation from the optimum loop size will cause a correspondingly large change in roller speed.

A significant feature of the straightener control according to the present invention is the manner in which the reference signal is set into the apparatus. In the preferred embodiment, a three digit thumbwheel switch divides the maximum straightener speed into 999 parts, with a setting of '500' being approximately fifty percent of the rated speed. This enables a precise numerical value to be assigned to each job so that, depending on the speed of the press, size and thickness of the stock, and other factors, a very precise setting can be established for this job so that all the operator or setup man need do is read the numerical setting off the job sheet and set it into the machine. This is in contrast to many prior art systems wherein the operator or setup man must fine tune an infinite adjustment type control knob while monitoring the size of the loop or reading a meter of some sort which has graduations related somehow to the size of the loop.

With the value loaded into the thumbwheel control, the straightener remains inactive until the press motor is started, at which time the straightener motor will also start but the stock will not feed until the press starts pulling stock. At this point, the control arm will raise due to the press taking up part of the loop, and at the same time the control arm transmits a plus or minus percentage of error in relationship to the thumbwheel setting, and this produces an output signal which cause the eddy current control to speed up or slow down slightly to correct for overspeed or underspeed of the stock.

A further feature of the loop follower control is that, when the press stops, the control will continue to feed stock through the roller although at a decreasing speed until the loop reaches a predetermined size, which is greater than the optimum running size. This will be sensed by a limit switch that will then cause the straightener to stop until the press is again restarted. An advantage to this feature is that the press will always start with a maximum loop size available thereby enabling smooth starting and operation of the straightener. If the loop size were too small and the press were operating at a high speed or pulling a large increment of stock when it was restarted, the straightener may not be able to respond quickly enough to supply the necessary stock.

Specifically, the present invention relates to a press installation comprising a coil of strip stock, a press, a press feed for feeding strip stock into the press, and a motor driven straightener positioned between the coil and feed for feeding stock into the press and removing the curvature from the stock caused by its coiled condition. The stock is slack between the straightener and press so as to form a loop, and the present invention is specifically concerned with apparatus for controlling the speed of the straightener so that a substantially uniform loop is maintained as the press is operated. The control apparatus comprises a control arm mechanism that engages the loop of stock and is adapted for moving in accordance with the size of the loop, and a potentiometer connected to the control arm mechanism for producing on an output electrical feedback signal, the magnitude of which varies proportionally with the movement of the control arm mechanism. A variable speed motor drive drives the straightener rollers and has a control input, the motor drive including means for varying the speed of the straightener proportionally in response to a control signal on the control input. A manually settable loop size control generates a reference signal having a variable magnitude, and includes a digital display for displaying a multiple digit number corresponding to the magnitude of the reference signal; and a feedback control circuit has a first input to which the feedback signal is connected, a second input to which the reference signal is connected, and an output connected to the motor drive control input, and includes means for generating a control signal on its output which is proportional to the deviation of the feedback signal from the reference signal. A long loop limit switch is positioned to be actuated by the control arm mechanism when the loop reaches a predetermined size, and means are provided for adjusting the spatial relationship between the control arm mechanism and limit switch whereby the point in the path of movement of the control arm mechanism whereat the limit switch is actuated can be varied. The feedback control continues to cause the drive mechanism to drive the straightener, even after the press is stopped until the limit switch is actuated, to thereby cause the loop to attain the predetermined size prior to restarting of the press.

It is an object of the present invention to provide a loop follower straightener control for use with a mechanical or other type of press which is economical to manufacture and can be easily installed on existing straighteners.

It is a further object of the present invention to provide a loop follower straightener control wherein the loop of material between the straightener and press can be maintained at a substantially constant size without the intermittent start/stop operation of some prior art controls.

A still further object of the present invention is to provide a loop follower straightener control wherein the reference setting can be set into the apparatus by a digital device or by reading a digital display, thereby allowing a numerical value to be assigned to each job to be run on the press.

Yet another object of the invention is to provide a straightener control wherein the loop is maintained at a substantially constant size during operation of the press, yet increases to a predetermined larger size when the press is stopped, without the necessity for complicated electronic circuitry.

These and other objects of the present invention will become apparent from the detailed description of a preferred embodiment of the invention taken together with the accompanying drawings.

DETAILED DESCRIPTION

Figures 1, 5:
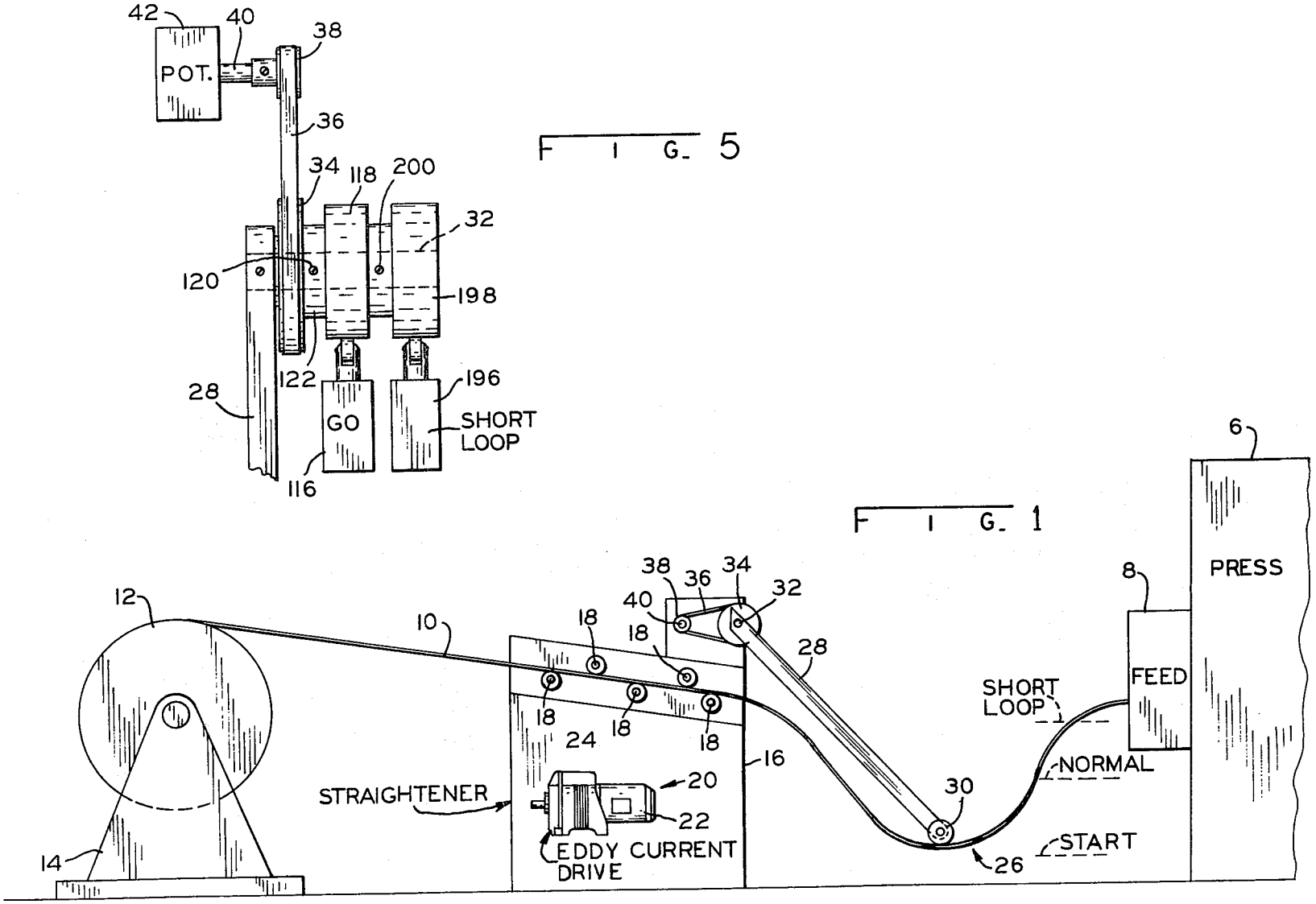
FIG. 1 is a diagrammatic view of the press installation including the loop follower straightener control of the present invention.
FIG. 5 is a detail of the adjustable cam limit switch device.

Referring now to FIG. 1, there is illustrated in diagrammatic fashion a press 6 and, which may be a mechanical press, for example, or other machine and a press feed 8 on its infeed side which intermittently feed metal strip stock 10 into press 6. Feed 8 may be of any conventional type, such as a cam feed. The strip stock is stored on a large reel or roll 12 supported on a stand 14 and adapted to unroll in a continuous fashion. Positioned between reel 12 and press feed 8 is a straightener 16, which again may be of conventional design comprising a plurality of rollers 18 driven by a motor drive mechanism 20, comprising a constant speed motor 22 and an eddy current coupling 24. The purpose of straightener 16 is to continuously draw stock 10 off reel 12 and remove the curvature from the stock 10 caused by its being stored in a coiled condition.

In order to be able to pay off the stock 10 in a continuous fashion and to avoid jamming feed 8 or press 6 due to a variation in tension on the stock as it enters feed 8, a certain amount of slack in stock 10 is provided between straightener 16 and feed 8 so as to form a downwardly extending loop 26. A control arm 28 having a roller 30 mounted on its distal end is connected to shaft 32, which is pivotally mounted. A pulley 34 is connected to shaft 32, as is illustrated in greater detail in FIG. 5, and is connected by a timing belt 36 to a smaller diameter pulley 38. Pulley 38 is rigidly connected to shaft 40, which is the input shaft for a potentiometer 42. As the size of loop 26 increases or decreases, arm 28 will be caused to rotate downwardly and upwardly, respectively, thereby rotating the input shaft of potentiometer 42 so that the output signal produced by potentiometer 42 varies in a proportional manner.

Under ideal conditions, the loop 26 would have its lowest portion at the 'Normal' position as illustrated in FIG. 1, although this position may vary depending on the speed of press 6, the width or thickness of the stock 10, or the increment of stock which is fed into press 6 on each cycle thereof. Also illustrated in FIG. 1 is a short loop position so that when arm 28 is raised to this position, a control signal is sent to press 6 causing it to stop. This is so that damage to the press 6 or feed 8 will not occur in the event that straightener 16 is unable to feed stock 10 at the proper rate, as may occur if there is a slippage in the rollers 18 of straightener 16. Also shown in FIG. 1 is a start position, which is the depth of loop 26 at the start up of the press 6. As will be described in further detail, the follower control of the present invention includes a feature whereby loop 26 will be caused to increase to this size when press 6 is stopped.

Figure 2:
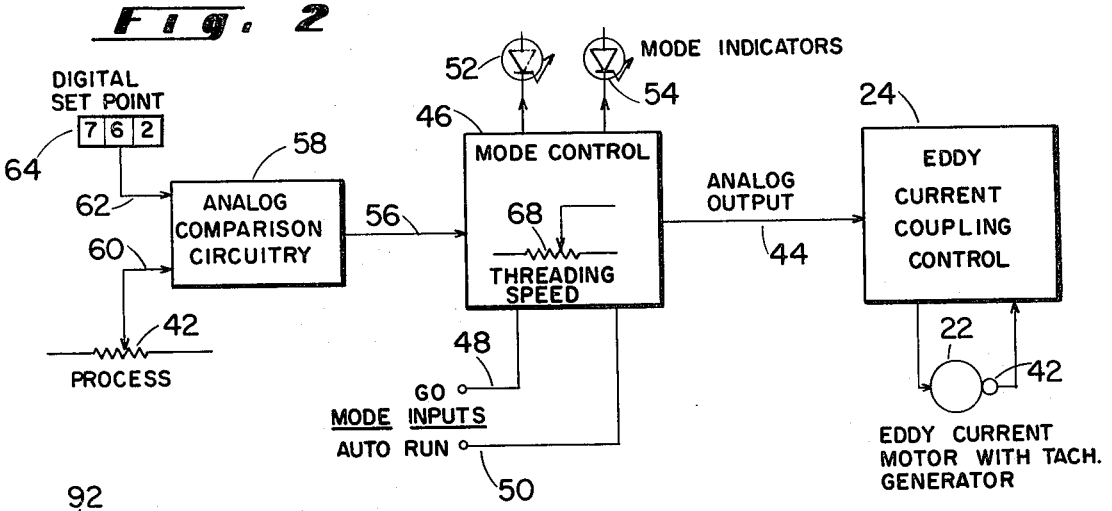
FIG. 2 is a block diagram of the loop follower straightener control.

FIG. 2 illustrates the overall block diagram of the system. Motor 22 is controlled by a conventional eddy current coupling control 24, and the control loop includes a tachometer generator 42. Eddy current control 24 has a control input 44 connected to the output of feedback control circuit 46, the latter having mode control inputs 48 and 50 and mode indicators 52 and 54. Feedback control circuit 46 has a control input 56 connected to the output of analog comparison circuit 58, which includes a first input 60 from the process potentiometer 42 and a second input 62 from the digital set point potentiometer 64.

Digital set point potentiometer 64 may be of conventional design and comprises a potentiometer having a digital input, such as a three digit thumbwheel selector, which has one thousand (1,000) different settings ranging from 0 to 999. The display or input of potentiometer 64 carries actual numerals so that the operator or setup man can simply dial in the proper setting for the particular job being run without the necessity to monitor a meter wherein the needle points to graduations having some relationship to the size of loop 26. As an alternative to using thumb wheel switches for potentiometer 64, dial type knobs could be used and a digital display could indicate the setting of the input switches of knobs. The primary requirement of potentiometer 64 is that it will be capible of being read directly as a multiple digit number. As a alternative for the potentiometer for the digital set point control, other types of variable current or voltage sources could be used.

Figure 3:
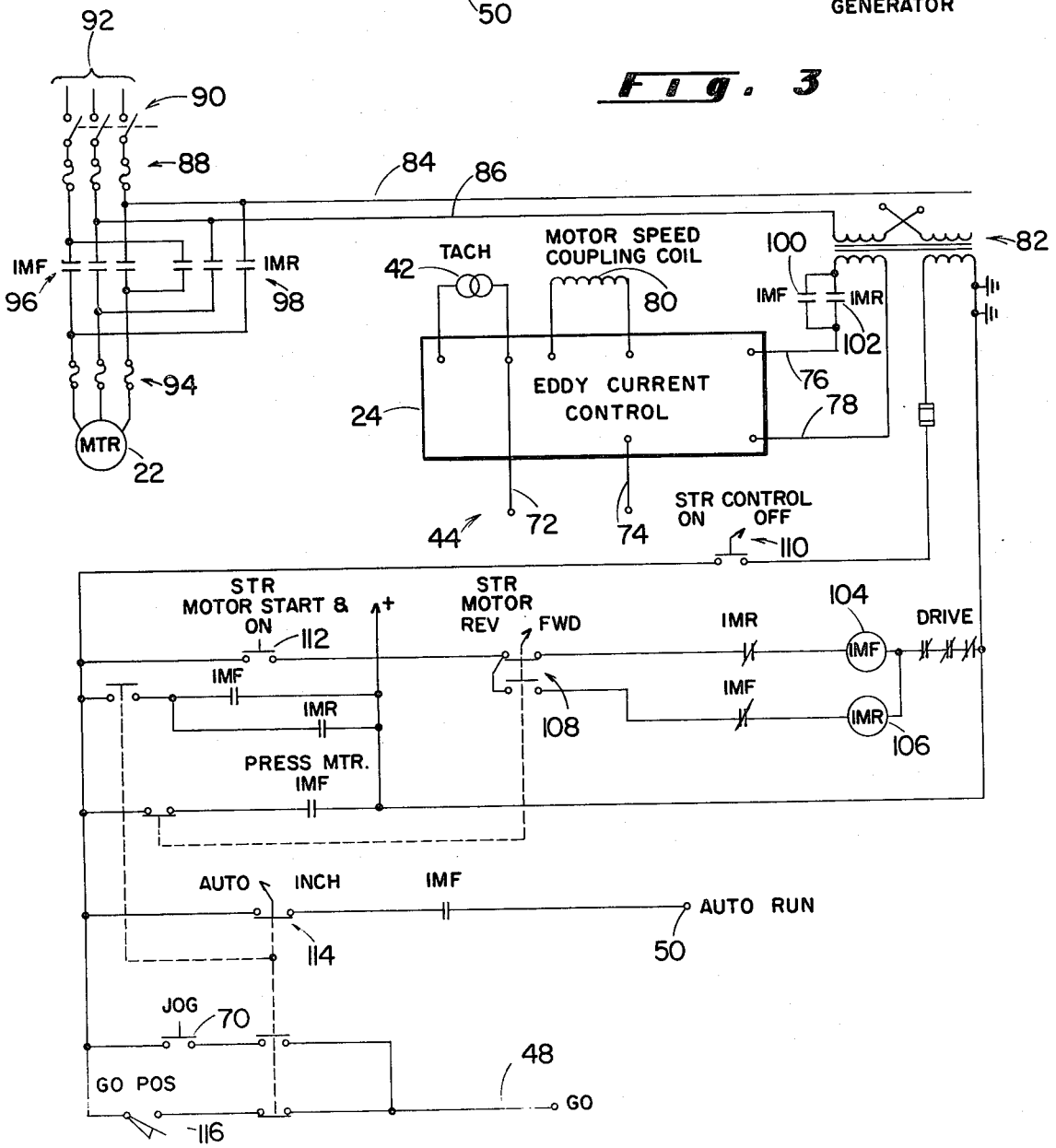
FIG. 3 is a detailed schematic of the switching circuitry and straightener drive mechanism.

Process potentiometer 42 produces an output current on line 60 which is proportonal to the angular position of its input shaft 40 (FIG. 5). Analog comparision circuit 58 sums the currents on inputs 60 and 62 and produces an output voltage on line 56 that is proportional to the sum of the two input currents. Alternatively, the analog comparison circuitry could be a comparator wherein the process input 60 is compared to the reference input 62 and a proportional output current or voltage produced on line 60. Other techniques for measuring the deviation of the process input 60 from the reference input 62 could also be used, if desired. Control circuit 46 enables the system to be operated either in the automatic mode or in a manual or 'jog' mode depending on the state of control inputs 48 and 50. If inputs 48 and 50 are inactive, then the analog output 44 will be proportional to the input 56, which is determined by the deviation of the process input 60 from the reference input 62, and mode indicator 52 will be illuminated to indicate this mode. Alternatively, if only input 48 is active, then the output 44 will be at a constant level depending on the setting of internal potentiometer 68, and control can be achieved through a momentary-type jog switch 70 (FIG. 3). The purpose of the jog mode is to enable the setup man to manually thread the stock 10 through straightener 16 during setup of the press. Mode indicator 54 will be illuminated when the system is in the jog mode.

Although motor 22 runs at a constant speed, the coupling between it and rollers 18 and straightener 16 can be controlled by eddy current coupling control 24 depending on the magnitude of the input voltage on input 44. Eddy current control 24 can be varied so that the effective drive connection between motor 42 and rollers 18 can range from complete decoupling to one hundred percent drive. Basically, eddy current control 24 functions as an electromagnetic clutch.

FIG. 3 shows eddy current control 24 as having a control input 44 comprising leads 72 and 74, power supply inputs 76 and 78, a tachometer 42, and motor speed coupling coil 80. The power supply inputs 76 and 78 are connected through transformer 82 to power lines 84 and 86, which in turn are connected through fuses 88 and switches 90 to three phase power inputs 92. Motor 22 is connected through fuses 94 through motor control contacts 1MF 96 for the motor forward direction and through motor control contact 1MR contacts 98 for the reverse direction. Contacts 96 and 98, as well as contacts 100 and 102 for eddy current control 24 are controlled by relays 104 and 106, which in turn are alternately actuated by the position of motor control switch 108. Straightener control on/off switch 110 disables both relays 104 and 106 when the straightener 16 is turned off.

Motor 22 is started by closing switch 112 thereby activating either relay 104 or 106, depending on the position of switch 108, and causing the associated contacts to either open or to close, depending on whether they are normally closed or normally open contacts. With the mode switch 114 in the automatic mode, output 50 will be active as will output 48 if limit switch 116 is closed, thereby causing output 44 to be proportional to the input 56 of mode control circuit 48 (FIG. 2). Limit switch 116 is normally closed unless the loop 26 exceeds the start position shown in FIG. 1. Limit switch 116 (FIG. 1) is opened by a cam 118 connected to shaft 32, which in turn is rotated by the movement of control arm 28. When arm 28 is lowered to a predetermined position, limit switch 116 will be tripped thereby breaking the connection to output 40 (FIGS. 2 and 3) unless jog switch 70 is also closed. In order to adjust the angular position of arm 28 at which limit switch 116 will be tripped, can 118 is adjustably connected to shaft 32 by loosening its set screw 120 on collar 122, rotating cam 118 to the desired position, and then retightening set screw 120.

Returning now to FIG. 3, if the mode switch 114 is in the inch mode, then the voltage on output 48 will be determined by the setting of potentiometer 68 (FIGS. 2 and 4) and the position of jog switch 70.

Figure 4:
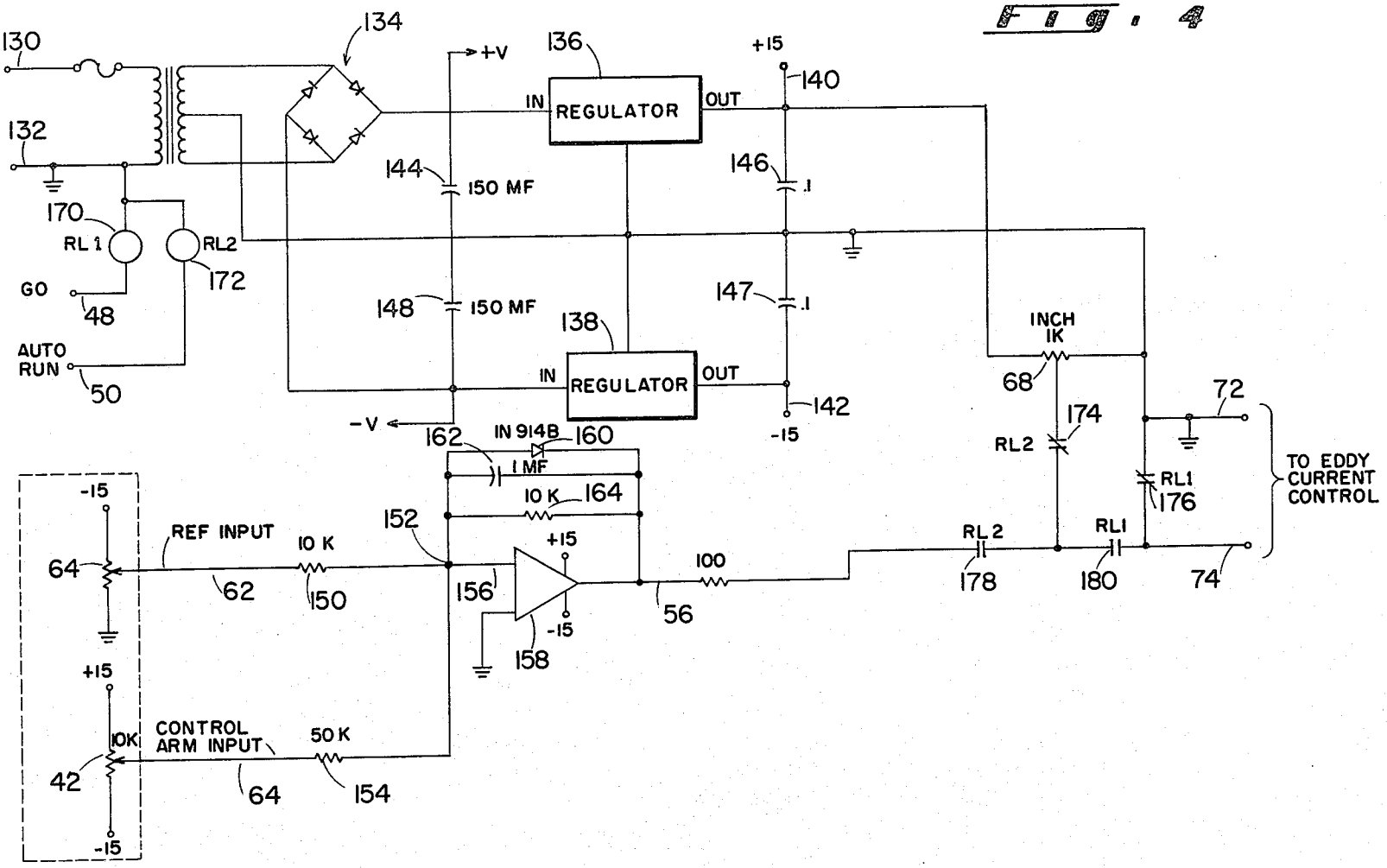
FIG. 4 is a detailed circuit schematic of the power supply and feedback control circuitry.

Referring now to FIG. 4, a 110 volt power supply is connected to inputs 130 and 132 through rectifier 134 to voltage regulators 136 and 138 to produce on outputs 140 and 142 positive and negative 15 volts of regulated power supply. Capacitors 144, 145, 146, and 147 are filtering capacitors. Outputs 72 and 74 are connected to eddy current control 24 (FIG. 3).

Reference input 62 from digital set point potentiometer 64 is connected through resistor 150 to summing point 152, and the output 64 from process potentiometer 42 is connected through resistor 154 also to summing point 152. Thus, the respective currents produced by potentiometers 64 and 42 are summed at point 52, which is connected to the input 156 of operational amplifier 158. The output 56 of operational amplifier 158 is proportional to the input current on input 156, which is proportional to the deviation of the current from process potentiometer 42 relative to the reference potentiometer output 62. Assuming, by way of example, that potentiometer arm 28 is in the optimum normal position, potentiometer 42 would produce no current on its output 64 so that only the reference current on input 62 would be connected to operational amplifier 58. This would cause eddy current control 24 to couple a given percentage of rotation of motor 22 to maintain loop 26 at this level. If, however, the loop 26 becomes smaller than optimum, then potentiometer 42 will produce a positive current on line 64 proportional to the amount of deviation, and this current will be added to the reference current on line 62 so that the input to operational amplifier 158 is greater than the 0 deviation input thereby producing a larger output current on line 56. If loop 26 is longer than optimum, then a negative current will be produced on line 64 by potentiometer 42 thereby decreasing the output current on line 56. This current is connected to eddy current control 24 by input 74. Diode 160 provides a negative clamping to type 307 operational amplifier 158, capacitor 162 just for the purpose of slowing down the reaction time of amplifier 158, and resistor 164 just for the purpose of generating the proportional voltage on the output 56 of amplifier 158.

Relays 170 and 172 will be energized depending on the state of inputs 48 and 50. If the system is in the automatic mode selected by closing switch 114 (FIG. 3), and if limit switch 116 has not been tripped, then both inputs 48 and 50 will be active so that relays 170 and 172 are energized thereby opening contacts 174 and 176 and closing contacts 178 and 180. This causes the output 56 of operational amplifier 158 to be connected to eddy current control 24 through input 74. If limit switch 116 is tripped, relay 172 will be deenergized, and the current on input 74 will be that that is set by potentiometer 68 and will occur only if jog switch 70 is closed. If the system is in the inch or jog mode, only relay 170 will be energized thereby causing contacts 178 to be opened and contacts 174 to be closed so that the output of potentiometer 68 will be connected to the input 74 of eddy current control 24.

Although a specific switching circuit has been disclosed, the invention, in its broadest form, is not limited to this particular configuration. Moreover, the system is not limited to an eddy current control for the coupling of motor 22 to straightener rollers 18, and other types of commercially available drives could be substituted.

Short loop limit switch 196 is connected to the press control circuit and stops the press 6 when loop 26 becomes too small. Limit switch 196 is actuated by cam 198 adjustably connected to shaft 32 by set screw 200.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a press installation comprising a coil of strip stock, a press, press feed means for feeding strip stock into the press, and a motor driven straightener means positioned between the coil and feed means for feeding the stock to the press feed means and removing the curvature from the stock, the stock being slack between the straightener means and press feed so as to form a loop, apparatus for controlling the speed of the straightener means comprising:

a control arm mechanism engaging the loop of stock and adapted for moving in accordance with the size of the loop, potentiometer means connected to said control arm mechanism for producing on an output an electrical feedback signal the magnitude of which varies proportionally with the movement of the control arm mechanism, a variable speed motor drive means for driving said straightener means and having a control input, said motor drive means including means for varying the speed of the straightener means proportionally in response to a control signal on said control input, a manually settable loop size control means for generating a reference signal having a variable magnitude and including a digital display means for displaying a multiple digit number corresponding to the magnitude of the reference signal, feedback control means having a first input to which the feedback signal is connected, a second input to which the reference signal is connected, and an output connected to the motor drive means control input, said control means generating a control signal on its output which is proportional to the deviation of the feedback signal from the reference signal, a long loop limit switch means connected to said straightener means and positioned to be actuated by said control arm mechanism to stop said straightener means when the loop reaches a predetermined size, and means for adjusting the spatial relationship between the control arm mechanism and limit switch whereby the point in the path of movement of the control arm mechanism whereat the limit switch is actuated can be varied, said feedback control means including means for continuing to cause said drive means to drive said straightener means, even after the feed means is stopped, until said limit switch is actuated, to thereby cause said loop to obtain the desired size prior to restarting of the press.

2. The press installation of claim 1 wherein said control arm mechanism comprises a pivotally mounted control arm wherein the angular position of the arm varies in accordance with the size of the loop, said potentiometer means includes a rotatable input shaft, and including means connecting said control arm to said potentiometer input shaft causing the angular rotation of the input shaft to be greater than the angular rotation of the control arm.

3. The press installation of claim 2 wherein the means for connecting said control arm to said potentiometer means input shaft comprises a timing belt and pulley arrangement.

4. The press installation of claim 1 wherein:

said control arm mechanism comprises a pivotally mounted control arm wherein the radial position of the arm varies in accordance with the size of the loop, and said means for adjusting the spatial relationship between the control arm mechanism and limit switch comprises a shaft rotated by said control arm, a cam mounted to said shaft and positioned to actuate said limit switch at a predetermined angular position of the shaft, and means for adjusting the angular position of the cam on the shaft.

5. The press installation of claim 4 including:

a short loop limit switch means connected to the press feed means for stopping the press feed means when the limit switch means is actuated, a second cam mounted on said shaft and positioned to actuate said short loop limit switch means at a predetermined angular position of said shaft, and means for adjusting the angular position of said second cam on said shaft.

6. The press installation of claim 1 wherein said motor drive means comprises an electric motor and an eddy current drive connected between said motor and rollers of said straightener means, and said motor drive means control input is a control input of said eddy current drive.

7. The press installation of claim 1 wherein said feedback control means comprises means for summing said feedback and reference signals and producing said control signal on its output which varies proportionally to the sum of said feedback and reference signals.

8. The press installation of claim 7 wherein said feedback control means comprises an operational amplifier having as it input the summation of the currents of said feedback and reference signals and having an output voltage which varies proportionally to the summation of the currents.

9. The press installation of claim 8 wherein said loop size control means comprises a potentiometer having a manually operable digital control having said digital display.

10. The press installation of claim 1 wherein said loop size control means comprises a potentiometer having a manually operable digital control having said digital display.

11. The press installation of claim 1 including jog control means for overriding said feedback control means and causing said drive means to drive said straightener means at a predetermined jog speed in response to the actuation of a manually operated jog switch.

12. The press installation of claim 11 and including means for adjusting the predetermined jog speed.

* * * * *